US005983598A

United States Patent [19]

Quinones

[11] Patent Number: 5,983,598

[45] Date of Patent: Nov. 16, 1999

[54] METHOD FOR WRAPPING STEEL COILS

[76] Inventor: Victor Manuel Quinones, 7123 Horizon Peak, San Antonio, Tex. 78233

[21] Appl. No.: 09/140,665

[22] Filed: Aug. 26, 1998

[51] Int. Cl.[6] ..... B65B 25/24; B65B 43/26; B65B 49/00

[52] U.S. Cl. ..... 53/409; 53/416; 53/449; 53/459; 53/455; 53/452; 53/461

[58] Field of Search ..... 53/409, 204, 452, 53/455, 461, 459, 457, 415, 416, 400, 401, 402, 449; 206/303

[56] References Cited

U.S. PATENT DOCUMENTS

| | | | |
|---|---|---|---|
| 2,371,858 | 3/1945 | Tuthill et al. . | |
| 3,253,379 | 5/1966 | Foradora | 53/449 X |
| 3,978,638 | 9/1976 | Sether | 53/452 X |
| 4,290,912 | 9/1981 | Boerwinkle et al. . | |
| 4,565,049 | 1/1986 | DeLigt et al. . | |
| 5,020,664 | 6/1991 | Hughes et al. . | |
| 5,071,501 | 12/1991 | Doi et al. . | |
| 5,163,556 | 11/1992 | Akao et al. | 206/303 |
| 5,426,916 | 6/1995 | Grigsby et al. . | |
| 5,477,659 | 12/1995 | Conrad et al. . | |
| 5,657,613 | 8/1997 | Quinones . | |

FOREIGN PATENT DOCUMENTS

| | | |
|---|---|---|
| 538907 | 4/1993 | European Pat. Off. . |
| 3-29764 | 2/1991 | Japan . |
| 5-4627 | 1/1993 | Japan . |
| 863468 | 9/1981 | U.S.S.R. . |

*Primary Examiner*—Linda Johnson
*Attorney, Agent, or Firm*—Richard C. Litman

[57] ABSTRACT

The method for wrapping a steel coil applies to wrapping a coiled material, particularly sheets of steel, aluminum and other metals which have been wound into a coil, in paper or a polymeric packaging material which contains a volatile corrosion inhibitor for storage or transport. The wrapper includes a cover piece, folded and sealed along one side, leaving two open sides, and a base piece. The base piece is placed on a pallet and the coil is placed on the base with the coil's axis of rotation perpendicular to the pallet. The base is secured to the coil and the coil is secured to the pallet with straps. The cover is placed over the coil with an open side traversing the width of the coil. A first edge of the open side is secured to the coil by adhesive tape, and the second edge is wrapped around the coil to overlap the first edge and also secured by tape. The two peaked corners of the cover are folded down over the top of the cover and secured by adhesive tape.

10 Claims, 9 Drawing Sheets

METHOD FOR WRAPPING STEEL COILS

BACKGROUND OF THE INVENTION

1. Field of the Invention

The present invention relates to a method for wrapping rolled material, particularly a roll or coil of metal, such as steel, aluminum, or other metal.

2. Description of the Related Art

In steel mills the steel is often made in sheets having a length many times greater than its width. The sheets are wound into coils for compactness during storage. The coils of steel may be stored on pallets for ease in moving and manipulating the coils. It is desirable to wrap the coils of steel in material which is relatively impermeable to water to prevent corrosion of the steel during storage and transport. The present invention relates to a method of wrapping steel coils in a material which is water resistant and which contains a volatile corrosion inhibitor.

Several methods of wrapping cylindrical objects and coils are known. U.S. Pat. No. 2,371,858, issued Mar. 20, 1945 to Tuthill, et al., describes a method of wrapping a roll of adhesive tape using two square sheets of cellophane by placing one sheet under the roll and wrapping the corners up the sides and extending over the top of the roll, placing the second sheet over the top with the corners of the second sheet between the corners of the first sheet, pulling the corners of the second sheet down the sides and under the bottom of the roll, and heat sealing with adhesive.

U.S. Pat. No. 4,565,049, issued Jan. 21, 1986 to DeLigt, et al., teaches a process for wrapping paper rolls which puts header sheets over the ends of the rolls, pulling the headers a short distance up over the rolls, pleating the headers, and securing the headers to the rolls by placing a strip of adhesive on the paper and pressing the headers against the paper, followed by capping the ends of the rolls.

U.S. Pat. No. 5,020,664, issued Jun. 4, 1991 to Hughes, et al. shows packaging a cylindrical broom with bristles inside a polygon shaped container with end caps which support the axial core of the broom so the bristles don't contact the package. U.S. Pat. No. 5,071,501, issued Dec. 10, 1991 to Doi, et al., discloses a method of wrapping a roll like article in which a core extends from both ends of the roll.

U.S. Pat. No. 5,477,659, issued Dec. 26, 1995 to Conrad, et al., describes another method for wrapping rolls of paper in which an inner end cover is affixed to a core by stapling or by nails, the roll is covered by a shroud which is wrapped and pleated over the ends, and outer end covers are glued to the pleated shroud, air being removed by heating during the process.

European Patent No. EP 538,907, published Apr. 28, 1993, and Japanese Patent 5-4627, published Jan. 14, 1993, show similar methods of wrapping annular ring shape articles with heat shrink packaging by wrapping a cylinder of material around the outside of the ring, folding the ends over the sides, passing metal rings through the inside of the article, and heat sealing the inside of the ring. Japanese Patent No. 3-29764, published Feb. 7, 1991, teaches a method of wrapping a coil of wire with covers using string to secure the covers.

My own prior patent, U.S. Pat. No. 5,657,613, issued Aug. 19, 1997, describes a method of wrapping steel coils with their axis of rotation parallel to the ground, involving folding and pleating a sheet of tear resistant material, punching a hole through the top and bottom ends, threading a first rope or string through the holes in the top end and a second rope through the holes in the bottom end, placing the coil on the sheet so that the ropes parallel the edges of the coil, wrapping the ends around the coil and securing them with adhesive tape, pulling the strings taut so that the ends of the sheet form a circle of smaller diameter than the core of the roll, and securing the ends of the sheets inside the core.

Various methods of making packaging materials which describe means for inhibiting corrosion include U.S. Pat. No. 4,290,912, issued Sep. 22, 1981 to Boerwinkle, et al. (a volatile corrosion inhibitor having (1) a polyolefin polymer, (2) an inorganic nitrite salt, (3) a trisubstituted phenol, and (4) fumed silica, in order to avoid problems with sodium nitrite in environments which lack carbon dioxide); U.S. Pat. No. 5,426,916, issued Jun. 27, 1995 to Grigsby, et al. (composite material impregnated with a liquid such as mineral oil which slowly releases and coats the article to avoid corrosion); and Soviet Invention Certificate No. 863, 468 (a press filled with polystyrene foam tablets and smeared with an oil containing a corrosion inhibitor, the oil penetrating the foam and the inhibitor being baked into the polystyrene).

None of the above inventions and patents, taken either singularly or in combination, is seen to describe the instant invention as claimed. Thus a method for wrapping steel coils solving the aforementioned problems is desired.

SUMMARY OF THE INVENTION

The method for wrapping a steel coil applies to wrapping a coiled material, particularly sheets of steel, aluminum and other metals which have been wound into a coil, in paper or a polymeric packaging material which contains a volatile corrosion inhibitor for storage or transport. The wrapper includes a cover piece, folded and sealed along one side, leaving two open sides, and a base piece. The base piece is placed on a pallet and the coil is placed on the base with the coil's axis of rotation perpendicular to the pallet. The base is secured to the coil and the coil is secured to the pallet with straps. The cover is placed over the coil with an open side traversing the width of the coil. A first edge of the open side is secured to the coil by adhesive tape, and the second edge is wrapped around the coil to overlap the first edge and also secured by tape. The two peaked corners of the cover are folded down over the top of the cover and secured by adhesive tape.

Accordingly, it is a principal object of the invention to teach a method of wrapping a steel coil in order to protect the coil from the corrosive effects of moisture during storage and transport by providing a method of completely enclosing the coil in a wrapper having a volatile corrosion inhibitor.

It is another object of the invention to provide a method of wrapping steel coil in which the axis of rotation of the coil is perpendicular to the ground which is quick, uncomplicated, economical, and requires a minimum of manipulation of the coil.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Steel mills frequently manufacture sheets of steel having a length many times greater than its width. The sheets are subsequently wound into a coil or roll for compact storage and handling. Typically steel coils may be wound from sheets of varying length, and twenty to eighty inches in width, resulting in coils having a diameter between about twenty-five to eighty inches.

The present invention presents a method for wrapping steel coils for storage and transport following their manufacture at steel mills. The coils are wrapped in sheets of paper, such as kraft paper, or a tear resistant plastic material having one or more layers, at least one layer being impregnated with a volatile corrosion inhibitor, such as sodium nitrite, the layer impregnated with the volatile corrosion inhibitor being in direct contact with the metal coil. A suggested tear resistant polymeric material comprises polyethylene, although polypropylene might also be used. The method is illustrated in FIGS. 1 through 8.

Figure 1:
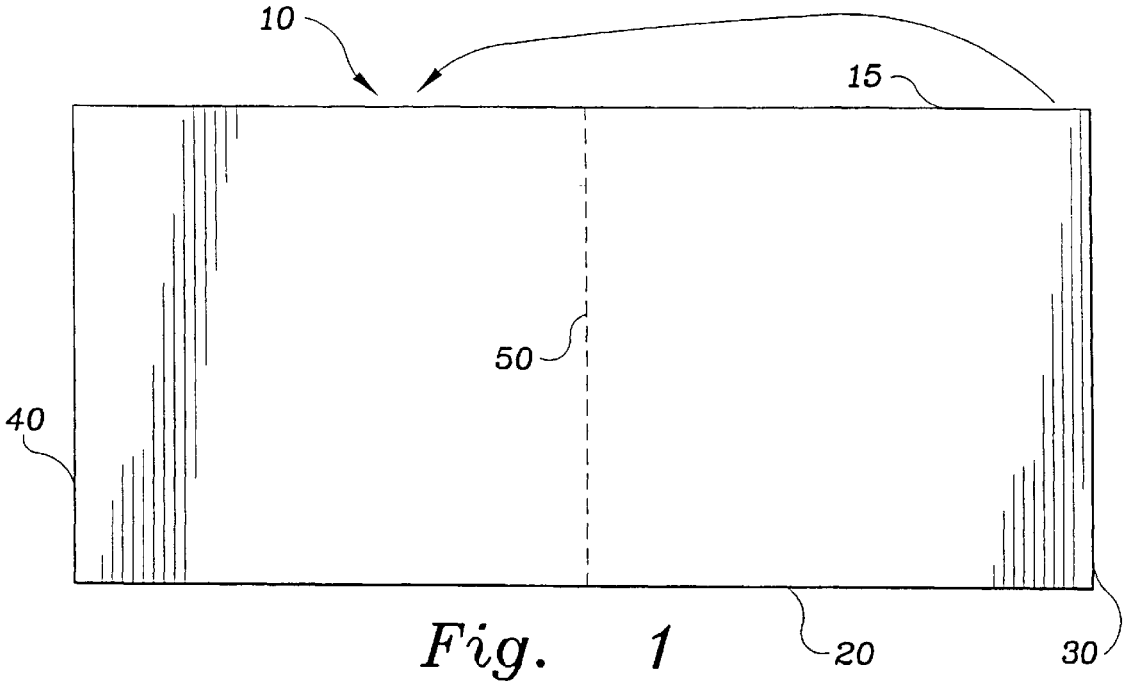
FIG. 1 is a plan view of the cover of a wrapper for wrapping steel coils according to the method of the present invention.
Figure 2:
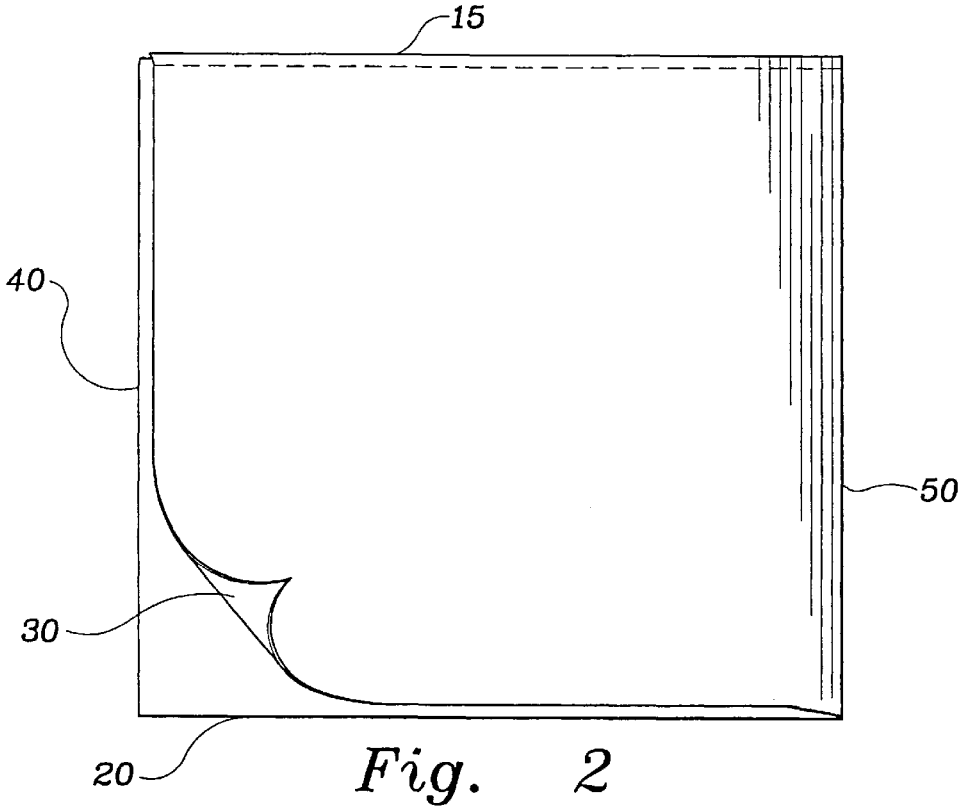
FIG. 2 is a plan view of the cover of FIG. 1 after being folded and sealed along an edge.

In the first step an appropriately sized rectangular or square cover sheet 10, having a first edge 15, opposing second edge 20, third edge 30, and opposing fourth edge 40, is folded along a line 50 bisecting the cover sheet 10. As shown in FIGS. 1 and 2, one of the edges perpendicular to the fold, the first edge 15 in FIGS. 1 and 2, is sealed by any appropriate means, such as a strip of adhesive, heat sealing, ultrasound, etc.

Figure 3:
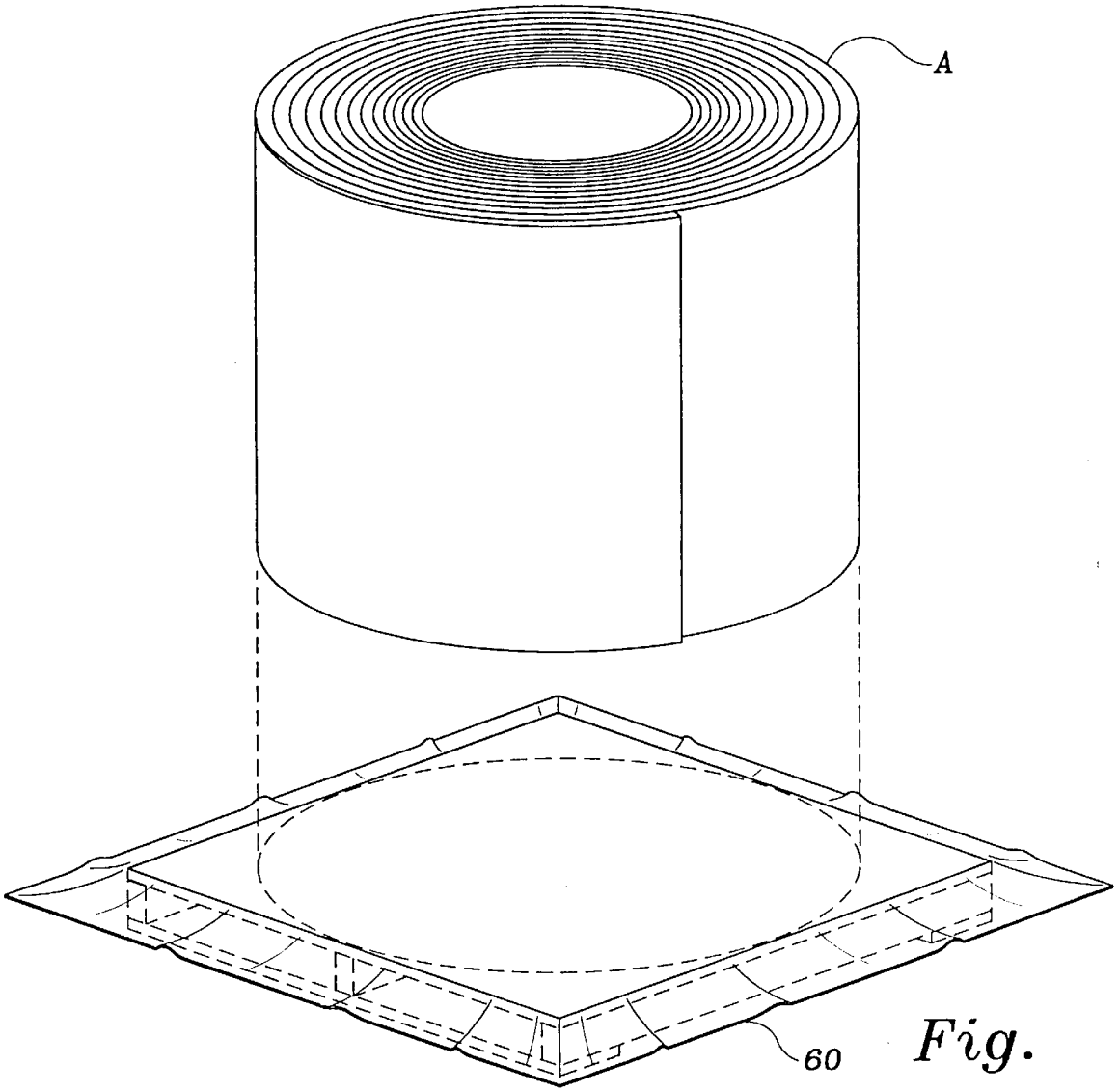
FIG. 3 is a perspective view of a steel coil being placed on the base sheet.
Figure 4:
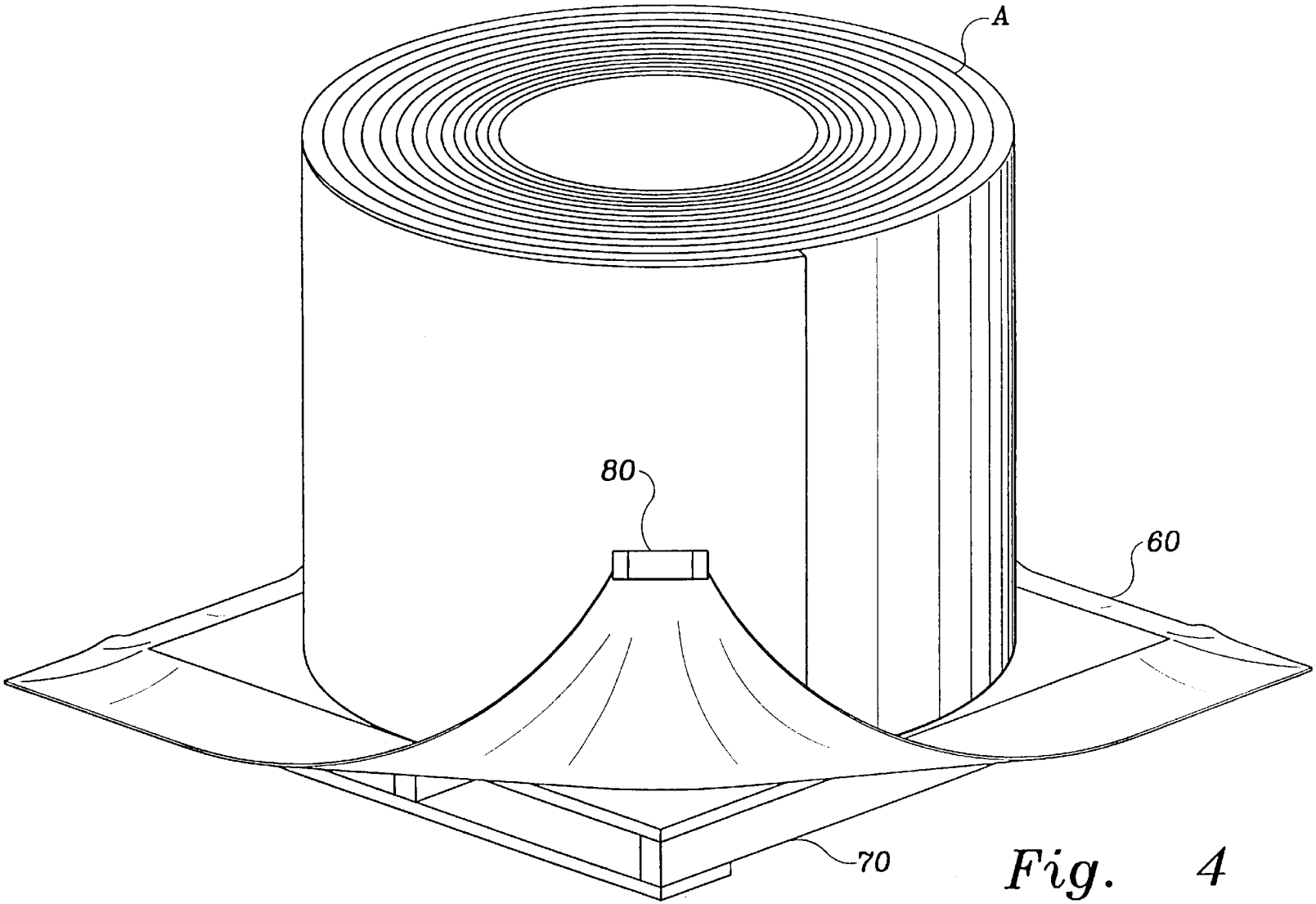
FIG. 4 is a perspective view showing the method of securing the base sheet to the coil.

As shown in FIGS. 3 and 4, a fully opened and extended base sheet 60 is centered on a pallet 70. If the material has more than one layer, the layer impregnated with the volatile corrosion inhibitor is facing up. A steel coil A is placed on the base sheet with the coil's A axis of rotation perpendicular to the pallet 70. The base sheet 60 should be large enough that the perimeter of the base sheet 60 extends beyond the circumference of the coil A in all directions. The corners of the base sheet 60 are folded up and secured to the outside surface of the coil A by an appropriate adhesive tape 80, such as duct tape, and the sides of the base sheet 60 between the corners are also secured to the coil by the same means.

Figure 5:
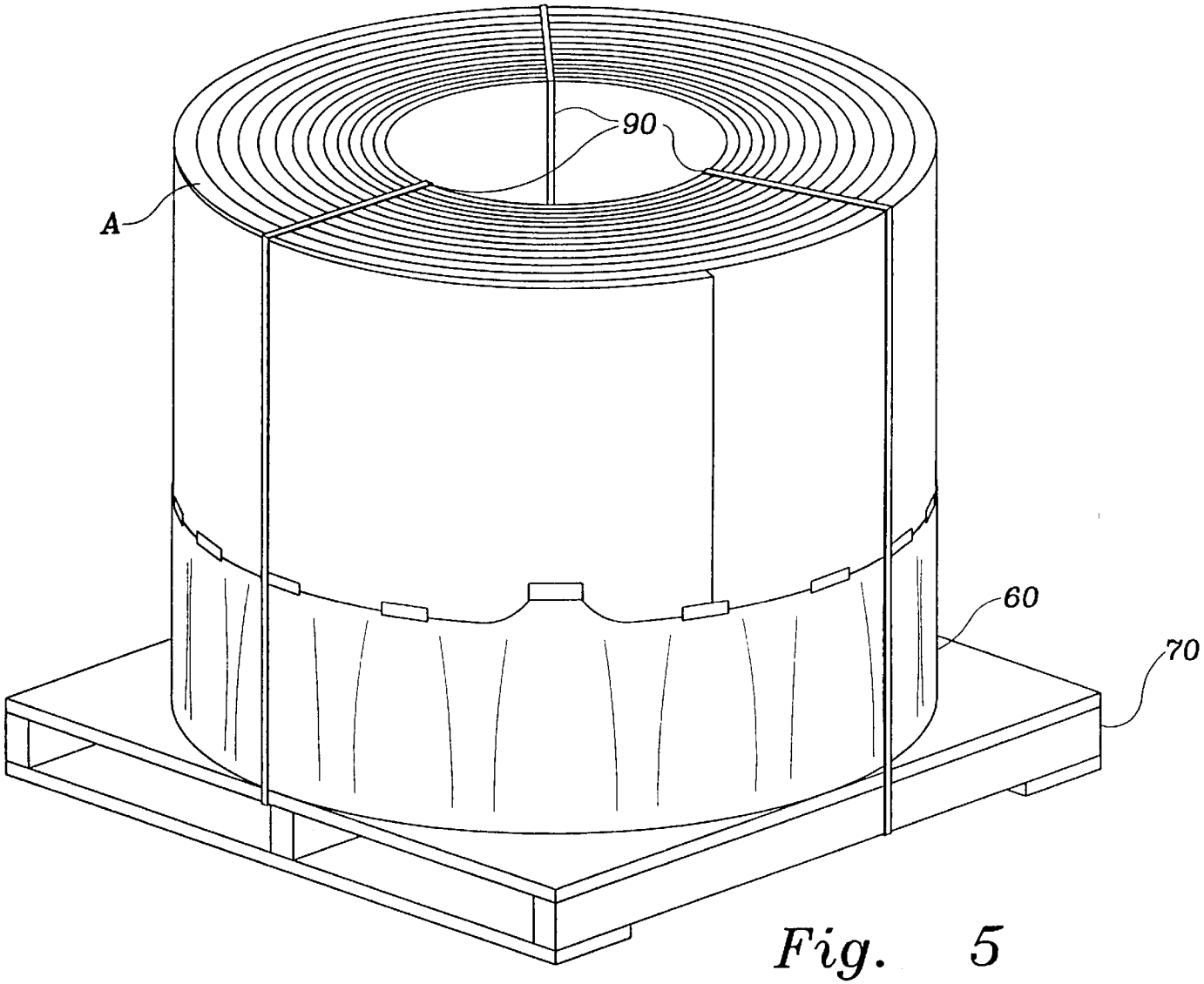
FIG. 5 shows a perspective view of the coil fastened to the pallet by metal straps.

As shown in FIG. 5, the coil A is secured to the pallet 70 by straps 90, which are passed through the center of the coil A, puncture the base 60, extend through the slats of the pallet 70, passing through the skid area of the pallet 70, in order to encircle the coil at different radial angles about the circumference of the coil A. The straps 90 may be metal straps, nylon straps, or other flexible fastening means. The top cover 10 is then opened and placed over the top of the coil A with a closed side, which may be either the folded edge 50 or the sealed edge 15, stretching across the top of the coil A parallel to the diameter of the coil A. The cover sheet 10 is selected so that the folded side is longer than the diameter of the coil, and so that the open edges 20, 30, and 40 extend beyond the ends of the base sheet 60, preferably covering the coil A for its entire width, when the cover 10 is placed over the coil A.

Figure 6:
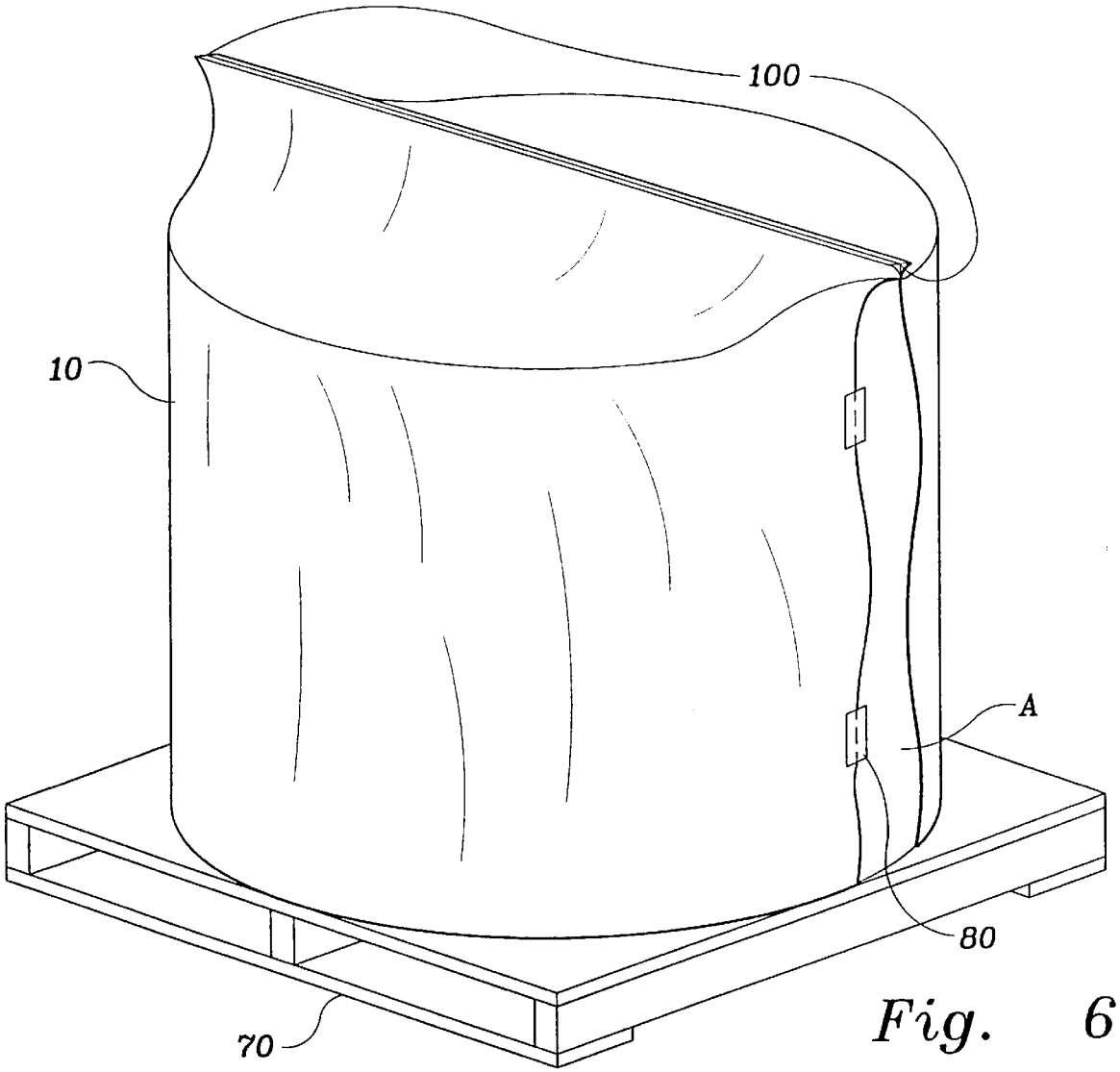
FIG. 6 is a perspective view showing an edge of the top cover being secured to the coil.
Figure 7:
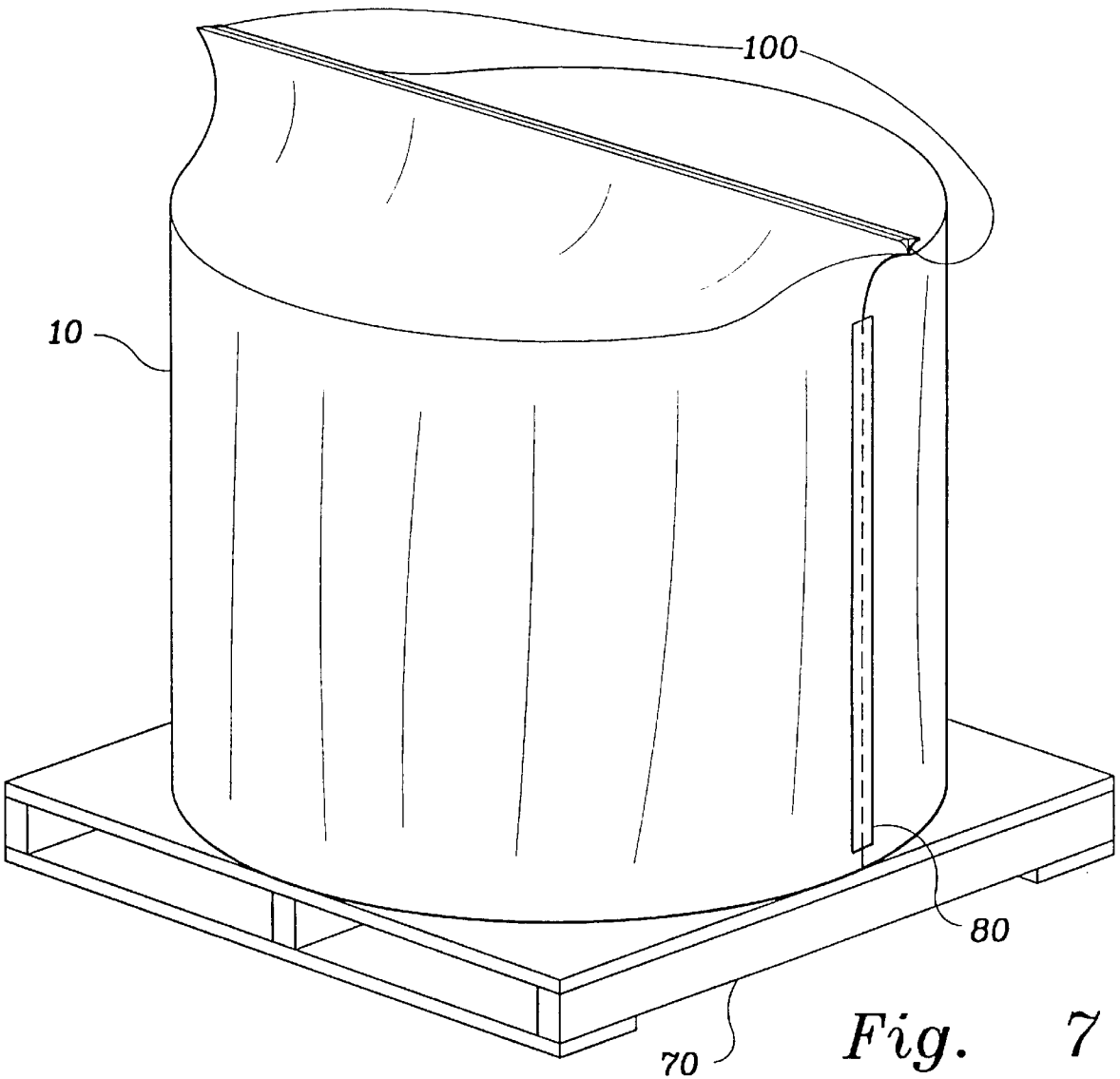
FIG. 7 shows a perspective view of the top cover completely sealed around the coil.
Figure 8:
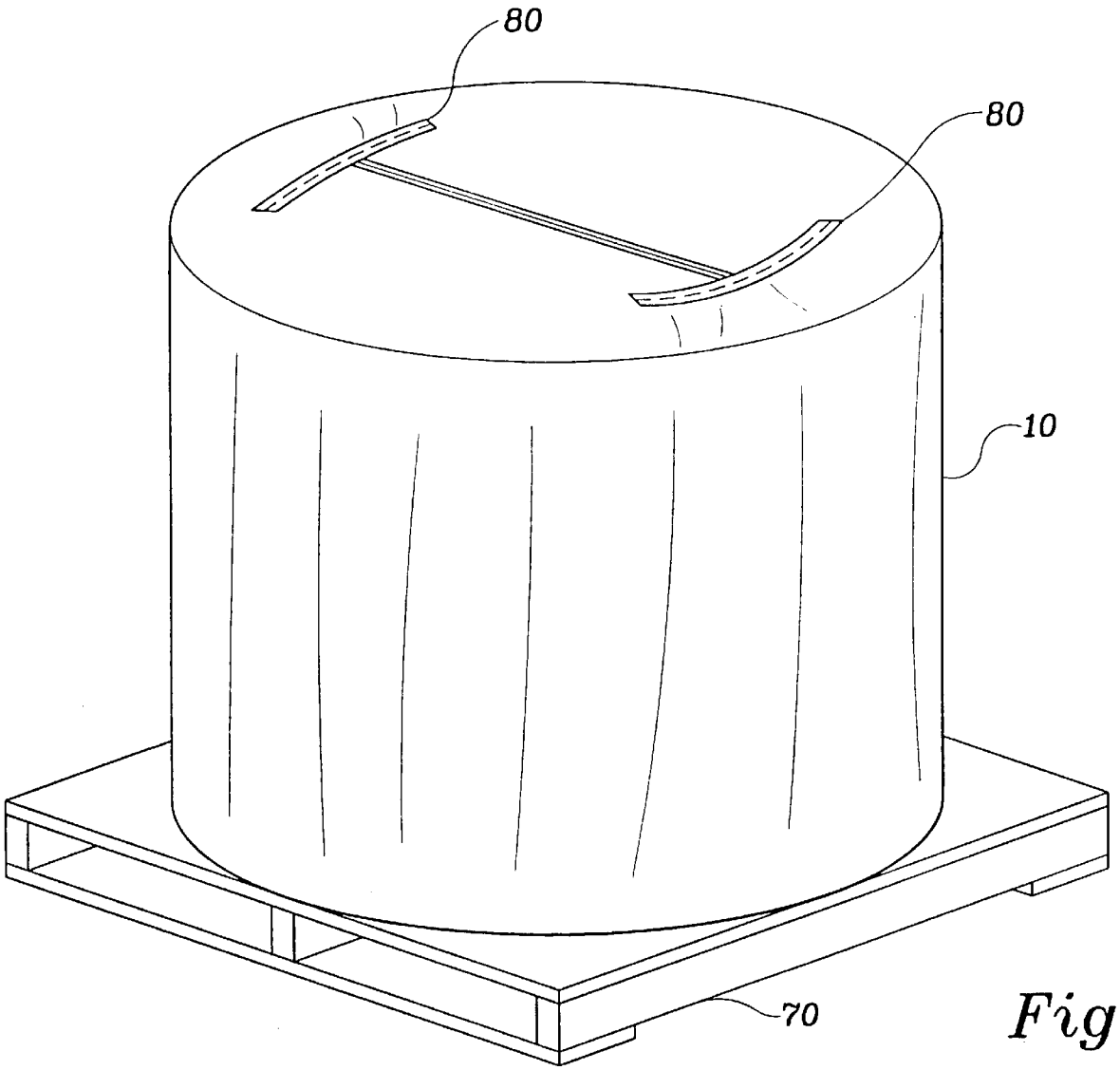
FIG. 8 shows a perspective view of a coil completely wrapped according to the method of the present invention.

As shown in FIG. 6, an edge of the cover 10 is secured to the outer surface of the coil A by adhesive tape 80. Then, as shown in FIG. 7, the opposing edge is wrapped around the circumference of the coil A in order to overlap the taped edge and is secured by adhesive tape for substantially the width of the coil A. At this point the cover 10 has closed edges along three sides and encloses the coil A on its top edge and around its circumference. There are, however, two corners 100 of the cover 10 projecting above the coil A due to the rectangular shape of the cover 10. As shown in FIG. 8, these corners 100 are folded down to lie flat on the top of the coil A and secured by adhesive tape 80, leaving the coil A completely wrapped and ready for storage or transport.

Accordingly, there has been shown a method for wrapping steel coils with a wrapping material impregnated with a volatile corrosion inhibitor by (1) preparing a rectangular or square cover sheet by folding the sheet along an axis bisecting the sheet; (2) sealing the edges of a side perpendicular to the fold; (3) selecting a base sheet with a surface area large enough for the perimeter of the base sheet to extend beyond the circumference of the coil in all directions; (4) opening the base sheet and centering it on a wooden pallet; (5) placing the coil on the base sheet with its axis of rotation perpendicular to the pallet; (6) securing the corners of the base sheet to the outer surface of the coil; (7) securing the edges of the base sheet between the corners to the outer surface of the coil; (8) selecting a cover with a closed side longer than the diameter of the coil and with the open edges extending beyond the taped edges of the base sheet when the cover is placed over the coil; (9) placing the top cover over the coil with a closed side parallel to the diameter of the coil; (10) securing an open edge of the cover to the outer surface of the coil; (11) wrapping the opposing open edge of the cover around the coil in order to overlap the taped edge and securing the opposing open edge; and, (12) folding the corners of the cover over the top of the coil and securing the corners to the cover.

Figure 9:
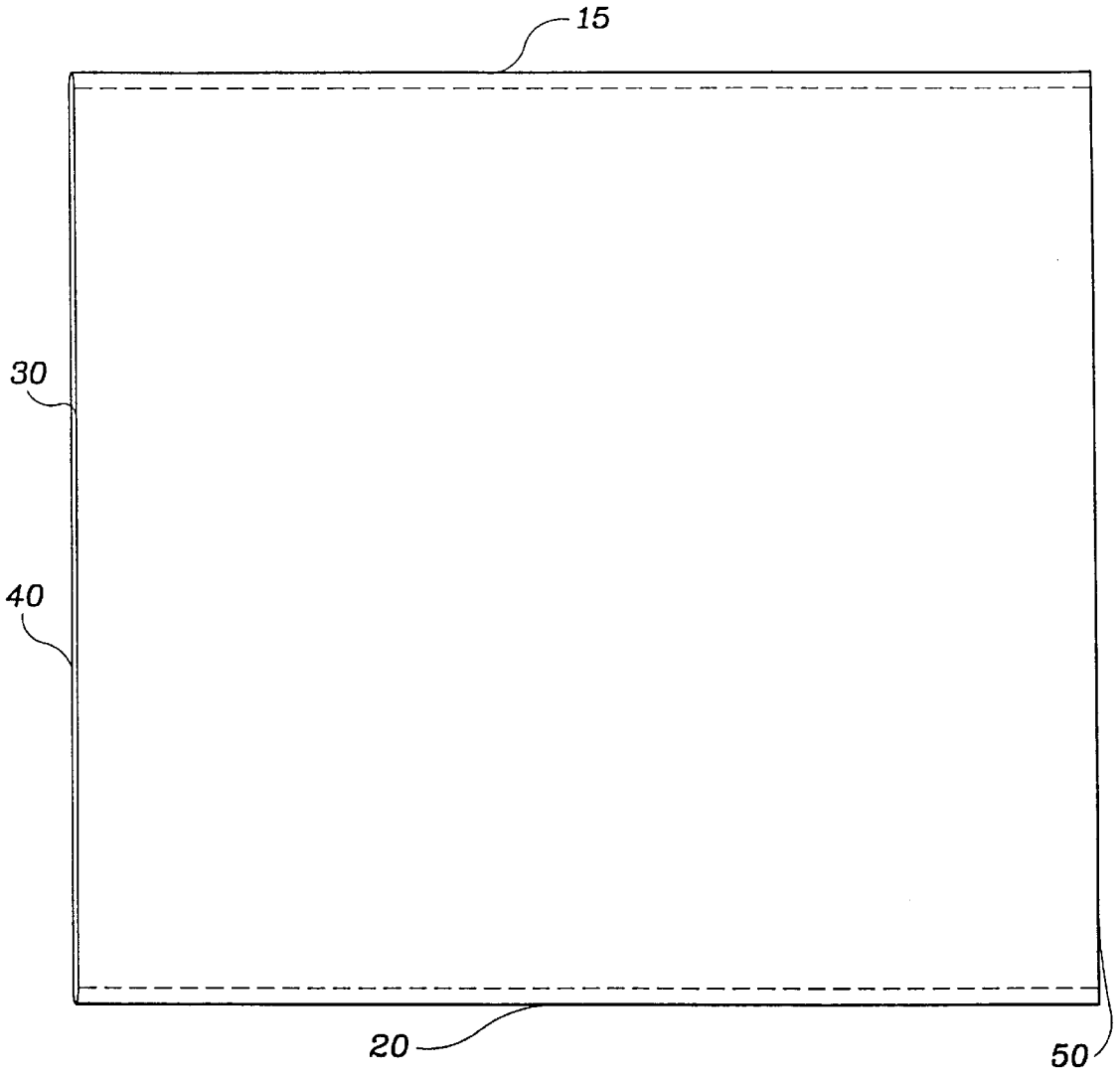
FIG. 9 is a plan view illustrating an alternate embodiment of the present invention showing a cover after being folded and sealed on both sides.
Figure 10:
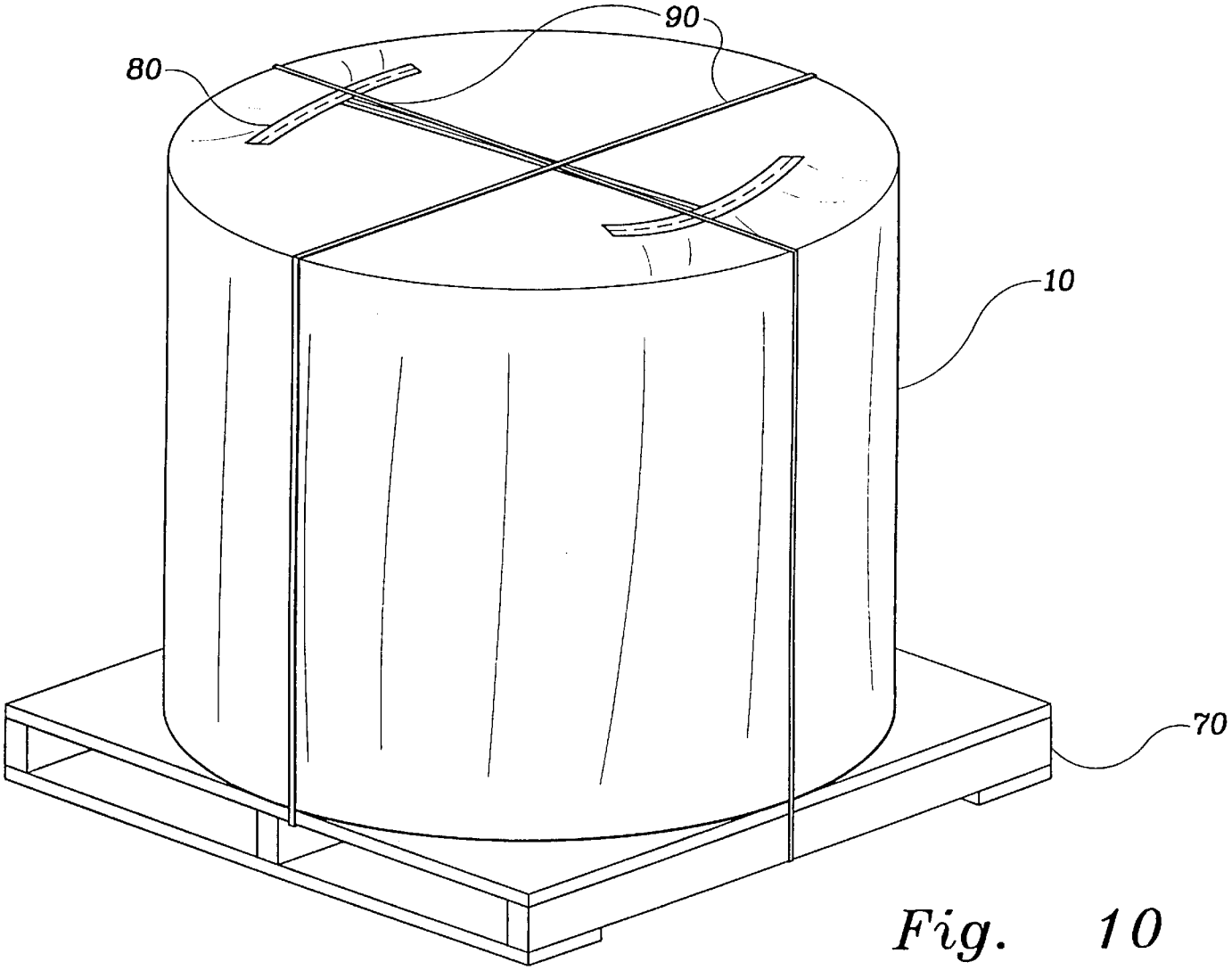
FIG. 10 shows a perspective view of an alternative embodiment of the method of the present invention showing the wrapped coil after being secured to the pallet by metal straps.

In an alternate embodiment of the method, the cover 10 is sealed along both opposing sides 15 and 20 to create a bag, as shown in FIG. 9, which is slipped over the top of the coil A and completely encloses the coil, eliminating the steps of securing an open edge of the cover 10 to the coil A, and wrapping the opposing edge around the coil A and securing it. In another embodiment, the step of puncturing the base sheet 60 with the straps 90 is eliminated. Instead, the coil A is secured to the pallet 70 after the coil A is completely wrapped by passing two or more straps 90 over the coil, down its sides, and under the skid portion of the pallet in criss-cross fashion as shown in FIG. 10.

It will be readily apparent that the method offers a quick, uncomplicated method for wrapping a steel coil in order to protect the metal from the corrosive effects of exposure to the environment. It will also be apparent that to some extent the order of the steps may be varied while accomplishing the purpose of the present invention in substantially the same manner, e.g., placing the coil on the base sheet before preparing the cover. It will further be apparent that although the method has been described for wrapping coils of steel, the method may also be applied to coils or rolls of aluminum, copper, tin, and other metals which may be made in sheet form and subsequently wound into coils or rolls.

It is to be understood that the present invention is not limited to the embodiments described above, but encompasses any and all embodiments within the scope of the following claims.

I claim:

1. A method for wrapping steel coils for storage or transport, comprising the steps of:

(a) preparing a rectangular or square cover sheet by folding the sheet along an axis bisecting the sheet;

(b) sealing the edges of a side perpendicular to the fold and leaving open edges parallel to the fold;

(c) selecting a base sheet with a surface area large enough for the perimeter of the base sheet to extend beyond the circumference of the coil in all directions;

(d) opening the base sheet and centering it on a pallet;

(e) placing the coil on the base sheet with its axis of rotation perpendicular to the pallet;

(f) securing the corners of the base sheet to the outer surface of the coil;

(g) securing the edges of the base sheet between the corners to the outer surface of the coil;

(h) selecting a cover with a closed side longer than the diameter of the coil and with the open edges extending beyond the secured edges of the base sheet when the cover is placed over the coil;

(i) placing the cover over the coil with a closed side parallel to the diameter of the coil;

(j) securing an open edge of the cover to the outer surface of the coil;

(k) wrapping the opposing open edge of the cover around the coil in order to overlap the secured edge and securing the opposing open edge; and (l) folding the corners of the cover over the top of the coil and securing the corners to the cover.

2. The method for wrapping a steel coil according to claim 1, wherein said cover sheet and said base sheet are impregnated with a volatile corrosion inhibitor.

3. The method for wrapping a steel coil according to claim 2, wherein said base sheet and said cover sheet are secured to the coil by adhesive tape.

4. The method for wrapping a steel coil according to claim 3, wherein said cover sheet and said base sheet are made from kraft paper.

5. The method for wrapping a steel coil according to claim 3, wherein said cover sheet and said base sheet comprise a plurality of layers, at least one layer of said plurality of layers being impregnated with a volatile corrosion inhibitor, and wherein said cover sheet and said base sheet are disposed so that said at least one layer of said cover sheet and said base sheet are in contact with said coil.

6. The method for wrapping a steel coil according to claim 3, further comprising the step of securing the coil to said pallet by means of a plurality of straps encircling segments of the coil radially.

7. The method for wrapping a steel coil according to claim 3, further comprising the step of securing the wrapped coil to said pallet by encircling the coil and said pallet with a plurality of straps in criss-cross fashion.

8. The method for wrapping a steel coil according to claim 3, wherein said cover sheet and said base sheet are made from a tear resistant polymeric material.

9. The method for wrapping a steel coil according to claim 8, wherein said tear resistant polymeric material comprises polyethylene.

10. The method for wrapping a steel coil according to claim 8, wherein said tear resistant polymeric material comprises polypropylene.

* * * * *